US005186465A

United States Patent [19]

Chorne

[11] Patent Number: 5,186,465

[45] Date of Patent: Feb. 16, 1993

[54] GOLF CLUB HEAD

[76] Inventor: Robert I. Chorne, 709 Jackie La., Baldwin, N.Y. 11510

[21] Appl. No.: 729,173

[22] Filed: Jul. 12, 1991

Related U.S. Application Data

[63] Continuation-in-part of Ser. No. 643,860, Jan. 22, 1991, abandoned.

[51] Int. Cl.[5] ..... A63B 53/04

[52] U.S. Cl. ..... 273/167 H; 273/169; 273/167 E

[58] Field of Search ..... 273/167 E, 169, 164, 273/167 F, 167 G, 167 D, 167 H, 167 J, 167 K, 170, 171, 172, 175, 164

[56] References Cited

U.S. PATENT DOCUMENTS 1,672,618 6/1928 Link ..... 273/169
3,966,210 6/1976 Rozmus ..... 273/169
4,431,192 2/1984 Stuff ..... 273/167 E
4,938,470 7/1990 Antonious ..... 273/164

FOREIGN PATENT DOCUMENTS 488469 7/1938 United Kingdom ..... 273/167 H

*Primary Examiner*—George J. Marlo

[57] ABSTRACT

A shaft is connected to a hosel at the heel end of a golf club head which is provided with a head section of reduced mass rearwardly of the central or "sweet spot" of the head. Approximately equal heel and toe mass relative to that centrally located are provided rearwardly of the lateral off-center hitting zones to counteract torques produced by such off-center contact which would result in undesired flight characteristics for the ball. The mass distribution allows for an overall lightening of the head while providing increased shot control by reducing torsion effects about the shaft.

1 Claim, 1 Drawing Sheet

GOLF CLUB HEAD

This application is a continuation-in-part application of application Ser. No. 643,860 filed Jan. 22, 1991, now abandoned.

The present invention relates generally to improvements in the construction of a so-called golf driver or fairway "wood", the improvements more particularly residing in the construction of the head thereof so as to enhance the swinging speed of the club while not detracting from and, in fact, actually increasing the ball-striking effectiveness of the club head by obviating the adverse consequences of inadvertent "toe" or "off-center" locations of contact with the golf ball.

EXAMPLE OF THE PRIOR ART

The speed at which a golf club head strikes a ball generates the force which determines the length it will travel, and it is already well known, as exemplified by U.S. Pat. No. 4,444,392, issued to Clovis R. Duclos on Apr. 24, 1984, that all factors being equal, lessening the club head weight and its air resistance will increase the speed or velocity of the swing and provide a desirable result.

In practice, however, the club head construction of the referenced patent, and of other known prior art patents similar thereto, have heretofore not provided meaningful benefits because accuracy as well as length are prerequisites for scoring well in golf, and the structural features of the prior art golf club heads which increase swinging speed invariably adversely effect accuracy in the line of flight; at any event, these prior art golf club head designs do not contribute to line of flight accuracy.

Broadly, it is an object of the present invention to provide an improved golf club head construction, for a tee-off driver or fairway "wood" overcoming the foregoing and other shortcomings of the prior art. More particularly, it is an object to provide a golf club head, of any appropriate selected construction material, which compared with any known prior art golf club head of like construction material, drives the ball significantly more accurately for the length occasioned by its swinging velocity, such that the line of flight accuracy in practice results in drives of greater distances than with prior art club heads, since there is no distance lost due to "off line" deviations, all as will be explained in detail in the description which follows.

The description of the invention which follows, together with the accompanying drawings should not be construed as limiting the invention to the example shown and described, because those skilled in the art to which this invention appertains will be able to devise other forms thereof within the ambit of the appended claim.

Figure 1:
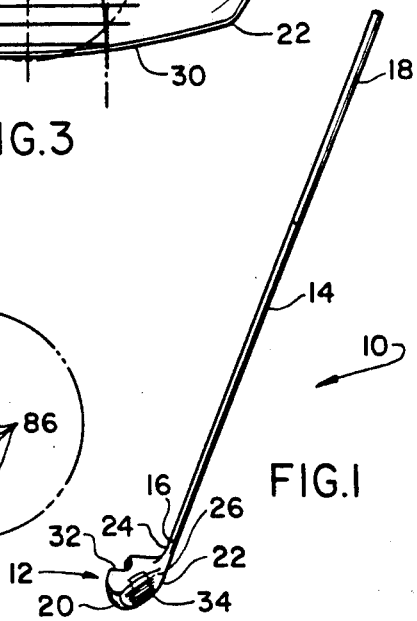
FIG. 1 is an overall perspective view showing an improved golf club consisting of the within inventive golf club head of the present invention with its attached shaft.

In FIG. 1 the within improved golf club head of the present invention is shown in an overall perspective view as an embodied component of a otherwise conventional golf club 10 of the "tee-off" driver or fairway "wood" type. As generally understood, club 10 has a head member 12, soon to be described in detail, attached to a shaft 14 at a hosel 16. The proximal end of shaft 14 is appropriately shaped and fitted with a hand grip section 18. In conventional golf parlance, the outboard section 20 of head 12 is known as the toe, while the inboard portion 22 is known as the heel. The section just above the heel 22 and below hosel 16 is typically referred to as the neck 24 of head 12.

In accordance with the present invention, constructionwise head 12 has a front face 26, a curved upper surface 28, a curved lower surface 30 and a trailing edge consisting of a contoured, C-shape in plan, providing the designated rear surface 32. The front or ball-striking front face 26 has a grooved pattern 34 on its surface for enhanced ball control. Golf ball 36 in phantom perspective is shown located at the ideal striking point 38, sometimes called the "sweet spot".

Figure 5:
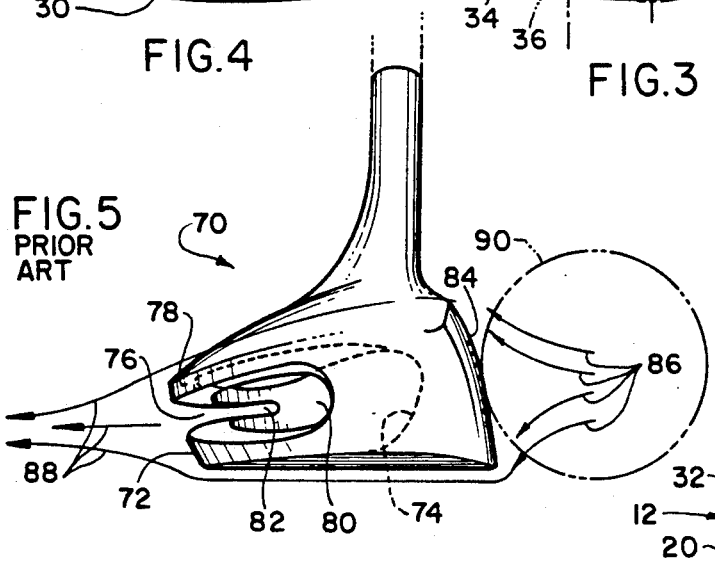
FIG.5 PRIOR ART
FIG. 5 is a view similar to FIG. 4, but of a prior art golf club head for comparison with the golf club head hereof.

When ball 36 is struck by a conventionally constructed driver, as exemplified by a club of a prior art design as shown in FIG. 5, at a point other than in the "sweet spot" area 38 along a horizontal reference line 40, torque and attendant vibration is created between the club head 12 and its attached shaft 14 which acts about a point 42. Point 42 is herein selected as a reference point denoting the intersection of line 40 and the center line 44 of shaft 14. The referred to torque, and particularly the vibration it causes, results in an other than intended straight trajectory of the ball 36, namely a "push" or "pull", which correspondingly shortens the length of the drive.

Figure 2:
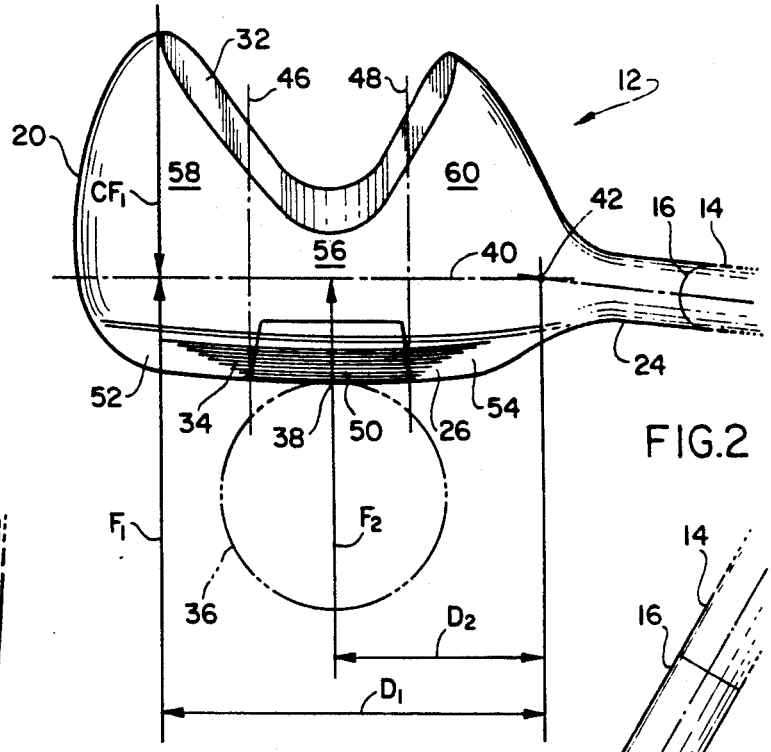
FIG. 2 is an isolated plan view of the golf club head shown in FIG. 1 to better illustrate structural details thereof.
Figure 4:
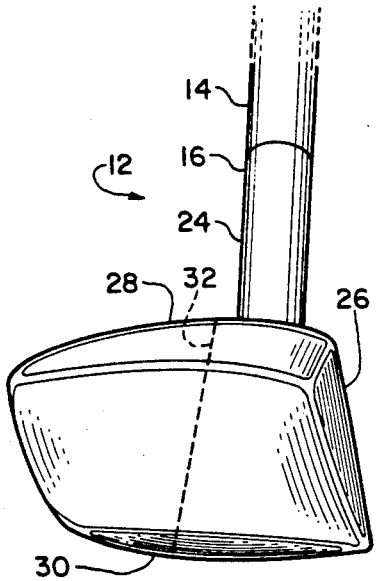
FIG. 4 is a left end elevational view projected from FIG. 3.
Figure 3:
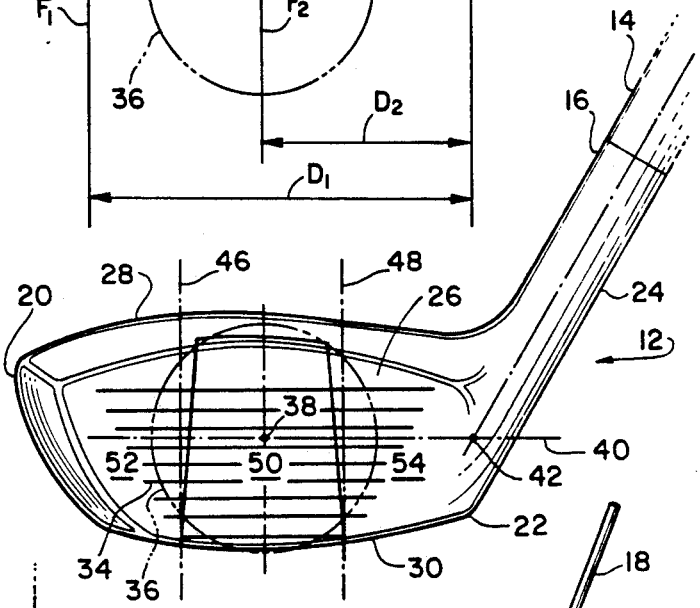
FIG. 3 is a front elevational view projected from FIG. 2.

In FIG. 3, front face 26 is shown divided into three general striking zones about a pair of vertical lines 46 and 48. A centrally located first ball striking zone 50 lies between lines 46 and 48. A second possible toe face ball-striking zone 52 is left or outwardly of line 46, while the third heel strike zone or area is to the right of line 48. Each of the three face areas 50, 52 and 54 have cooperating rearwardly projecting head masses 56, 58 and 60, respectively. Central mass 56 is much reduced when compared with either toe mass 58 or heel mass 60. This arrangement allows for a decreased overall weight of club head 12 to enable correspondingly increased club head speed during a ball striking swing.

A club head 12, proportioned in the manner just described, is designed to resist excessive shaft torque if ball 36 is struck at a spot other than the "sweet spot" 38, i.e. at distance D2. The weight of the ball 36 struck at location 38 produces force F2 which the shaft 14 counters without twist or vibration. When ball 36 is hit on the outwardly "off center" toe face strike area 52, the distance D1 is greater and so is the corresponding force Fl resulting in a potential shaft twist about point 42. To counter this, the inventive construction of the golf club head 12 proposes an increase in mass, such as the mass 58 at the toe to produce a neutralizing counteforce CF1.

Although not shown schematically in the figures, it follows that a similar situation of generated torque and vibration occurs when ball 36 is hit on the heel face strike area 54, but at this location only a minimal counterforce needs to be contended with. Nevertheless, in a preferred embodiment, mass 60 is selected to be the same approximate size as mass 58, and thus larger than mass 56, since the mass 60 in this selected size provides structural stability to the connection of the club head 12 to its shaft 14.

To better understand the advances in club head design represented by the construction of golf club head 12 as just described, it is helpful to contrast this design with that of the prior art club head 70 of U.S. Pat. No. 4,444,392 issued to Clovis R. Duclos on Apr. 24, 1984, intended also to embody the club head with structural features to provide an enhanced or increased club head speed. Thus, as shown in the prior art-labelled FIG. 5, club head 70 is provided by a contoured rear surface 72 consisting of a cavity 74 within the club head 70 which opens rearwardly through a shaped slot 76. The slot 76 extends around the periphery 78 of the rear 72 of the club 70 so that there is relatively less wind resistance as the club head 70 is swung to the impact position. The slot 76 is wider at the outer portion 80 thereof than at the inner portion 82. The front side wind pattern appears as indicated by the reference lines 86 in FIG. 5. On the trailing side of club head 70, slot 76 allows for smooth air streaming 88 which reduces turbulence and air resistance resulting in increased club velocity before impact with ball 90.

Although there is increased club head velocity as a result of decreased mass and the aerodynamic shape in head 70, this prior art golf club head construction or configuration does not allow for adequate mass distribution where it is required, and as is provided by the club head 12 of the present invention. This is particularly so in the case of an "off-center" or "toe" hit or contact with the ball, where the reduction in the mass of the prior art head 70 is not adequate to obviate shaft and club head torque and vibration, but is the same as the mass at the golf club head central hitting zone or "sweet spot". Underlying the present invention is thus the embodiment of the weight reduction technique in a golf club head design or construction to correspondingly increase club head swinging speed, but to do so selectively by eliminating mass only at the center or "sweet spot" 50, and to maintain an adequate mass 58 at the golf club head toe 52 to obviate the adverse consequences of a ball being struck at this location, as well as to maintain mass 60 at heel 54 as shown for the purpose previously noted. This arrangement of varying masses 58, 56 and 60 provides corresponding hitting zones 52, 50 and 54 which are all usable without adverse consequences, as compared with ball contact against the striking surface of a prior art driver, and thus the zones 52, 50 and 54 cooperate to provide an overall ball-striking zone of an optimum large size, visually recognizable by the rearwardly facing C-shaped contour in plan perspective of the masses 58, 56 and 60. It is noted, however, that the C-shaped appearance presented by variation in masses is understandably not essential to the ball-striking effectively of the golf club head 12, and that a shaped foam insert (not shown) can be adhesively adhered or otherwise attached to rear surface 32 to provide a conventional golf club head appearance.

While the golf club head 12 construction or design as herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claim.

What is claimed is:

1. An improved golf club head of the driver type having a hosel, a front face and a shaft having an elongated axis connected to extend from a first heel end of said head, said head comprising a centrally located first central ball-striking zone bounded by toe and heel ball-striking zones on said front face, a first head mass rearwardly adjacent to said first ball-striking zone and second and third head masses rearwardly adjacent said second and third head zones, respectively, said second and third masses being approximately equal and each of said second and third masses being substantially greater than said first mass to minimize torsion effects about said shaft axis due to ball contact with either of said second or third zones, said first, second and third zones being dimensioned to provide an overall preferred ball-striking zone of large size, said second and third masses extending rearwardly a substantially greater distance than said first mass and cooperatively defining a head having a substantial recess extending vertically in the periphery of the head rearwardly of said face between said second and third masses.

* * * * *